United States Patent [19]

Wei

[11] Patent Number: 4,515,319

[45] Date of Patent: May 7, 1985

[54] DUAL-INCLINED LIFTERS FOR AUTOGENOUS MILLS

[76] Inventor: Yun-Song Wei, 1005 Dana Ave., Apt. 9, Cincinnati, Ohio 45229

[21] Appl. No.: 578,870

[22] Filed: Feb. 10, 1984

Related U.S. Application Data

[63] Continuation-in-part of Ser. No. 396,494, Jul. 8, 1982, abandoned.

[51] Int. Cl.[3] ..... B02C 17/22

[52] U.S. Cl. ..... 241/284; 241/183; 241/299

[58] Field of Search ..... 241/181, 183, 91, 284, 241/299, 182, 26, 70, 71, 72, 76, 78, 79.2, 79.3

[56] References Cited

U.S. PATENT DOCUMENTS 2,470,315 5/1949 McGehee ..... 241/183 X

*Primary Examiner*—Mark Rosenbaum

*Attorney, Agent, or Firm*—Charles R. Wilson

[57] ABSTRACT

An autogenous mill for breaking up rocks comprises lifter bars and carriers. The lifter bars have angles of inclination so as to achieve the maximum efficiency of the mill with respect to lifting the rocks and causing them to fall. The angles of inclination of the carriers are also chosen so as to achieve the maximum efficiency of the carriers for lifting the crashed fines and causing them to exit the mill. The angles of inclination of the carriers is smaller than that of the lifter bars.

9 Claims, 4 Drawing Figures

DUAL-INCLINED LIFTERS FOR AUTOGENOUS MILLS

The application is a continuation-in-part application of Ser. No. 06/396,494, filed July 8, 1982, now abandoned.

The present invention is an improvement of the previous invention titled "Tilted Lifters for Autogenous Mills", which was filed in the United States Department of Commerce, Patent and Trademark Office on June 16, 1980, Ser. No. 06/159,666, now U.S. Pat. No. 4,358,062, by the same inventor.

BACKGROUND OF THE INVENTION

Figure 1:
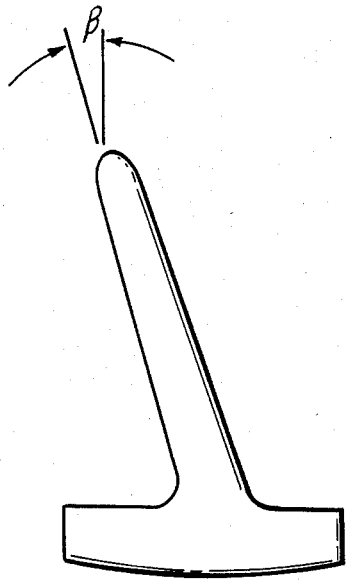

The lifter of the autogenous mill has dual purposes: first, it serves as a rock lifter, and second, as a carrier for withdrawal of the crashed fines. As a rock lifter, the angle of inclination of the lifter together with the speed of the mill should be so determined such that the crashing power or the crashing efficiency of the mill will be the maximum. While as a carrier for withdrawal of the crashed fines, same said angle of inclination together with same said speed of the mill should make the mean locus of the crashed fines pass through the center of the mill or the suction pipe. In my previous invention, the rock lifter and the carrier are the same; therefore, there is only one angle of inclination $\beta$ (FIG. 1). Since the mill has only one speed at any given instant, and the above two requirementsare so different to each other, it becomes evident that a single angle of inclination of the lifter could not fulfill both requirements at the same time.

REFERENCE TO DRAWINGS

FIG. 1 illustrates the inclined lifter in the previous invention claimed in U.S. Pat. No. 4,358,062.

$\beta$ is the angle of inclination of the lifter.

Figure 2A:
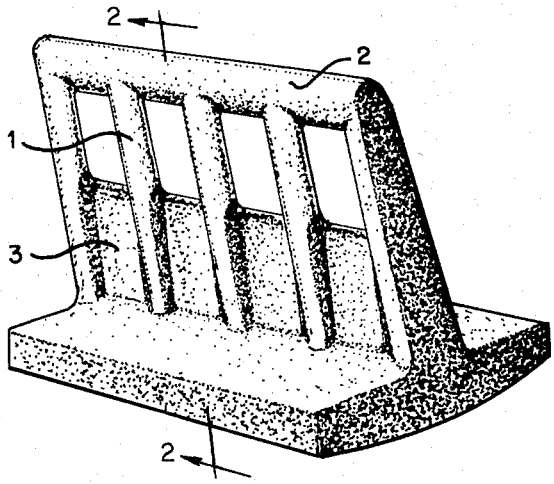
Figure 2:
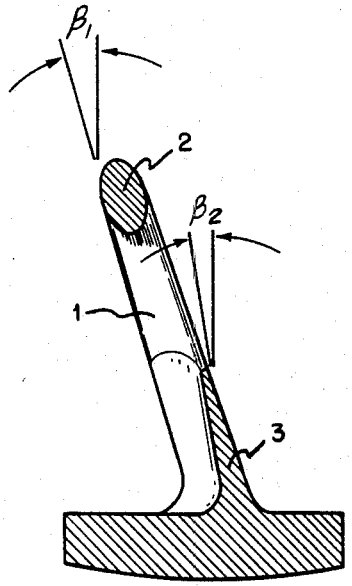

FIG. 2 illustrates the dual-inclined lifter in the present invention;

1 is the rock lifter bar;

2 is the cross beam;

3 is the carrier for crashed fines;

$\beta_1$ is angle of inclination of the rock lifter;

$\beta_2$ is the angle of inclination of the carrier.

Figure 3:
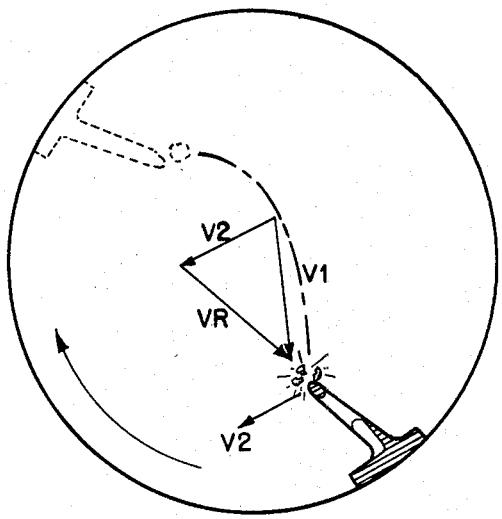

FIG. 3 illustrates the mean direction of the mean velocity of the falling rocks to the moving rock lifter bar;

$V_1$ is the mean absolute velocity of the falling rocks (mean direction);

$V_2$ is the velocity of the moving lifter;

$V_R$ is the mean relative velocity of the falling rocks to the moving lifter (mean direction).

DESCRIPTION OF THE INVENTION

In the present invention, the rock lifter bar 1 and the carrier 3 as shown in FIG. 2 compose different parts of the lifter. Said rock lifter bar is inclined along the direction of motion of the mill, with its direction in-line with the mean direction of the mean relative velocity of the falling rocks to the moving lifter (FIG. 3), i.e., with an even wear pattern of said rock lifter bar along both sides.

The angle of inclination $\beta_1$ of the rock lifter bar 1 and the speed of the mill are so determined such that the mill will deliver maximum crashing power or possess maximum efficiency, assuming even wear pattern of said rock lifter bar. The angle of inclination $\beta_2$ of the carrier

3 is determined on the basis of said speed of the mill such that the mean locus of the falling fines will pass through the center of the mill or the suction pipe. The cross beam 2 as shown in FIG. 2 serves as a stiffener of the the rock lifter bars, also as a natural part of gates of the casting.

The primary object of the invention is to raise the crashing power or the crashing efficiency of the autogenous mill to its maximum by proper selection of the angle of inclination $\beta_1$ of the rock lifter bar and the operating speed of the mill. Preferably $\beta_1$ ranges between 10° to 45° and the mill operates at 60% to 85% of its critical speed.

A further object is to ensure best efficient withdrawal of the crashed fines out of the suction pipe by proper selection of the angle of inclination $\beta_2$ of said carrier as a function of said speed of the mill. Preferably $\beta_2$ is 25° to 50° smaller than $\beta_1$. The angle $\beta_1$ is measured from the perpendicular, i.e. a line drawn perpendicular to the base of the lifter is the 0° line. The angle $\beta_2$ is also measured from the perpendicular. Accordingly, since the angle $\beta_2$ is 25° to 50° smaller than $\beta_1$, the angle of inclination of the carriers can be a negative number. In such a case, the carriers are inclined against the direction of motion of the mill.

The invention is, of course, not limited to the specific embodiements described and illustrated, but may be realized in various modifications and substitutions without departing from the spirit and scope of the appended claims.

What is claimed is:

1. In an autogenous mill including a casing and a number of lifters on both shell and liners within a casing, the improvement comprising said lifters having (1) rock lifter bars which are inclined along the direction of motion of the mill, said rock lifter bars having center lines which will substantially coincide with the mean locus of the falling rocks within the mill, said mean locus being substantially a logarithmic spiral, and said center lines being straight for better resistance to buckling and (2) carriers for withdrawal of crashed fines, said carriers having an angle of inclination smaller than that of said rock lifter bars, further in said carriers having their surfaces which will allow the mean locus of the crashed fines to pass through the center of the mill or the suction pipe.

2. An improvement according to claim 1 wherein the angles of inclination of the rock lifter bars and the speed of the mill are chosen to possess maximum efficiency and the angles of inclination of the carriers for the crashed fines is determined based on said speed so as to result in the mean locus of falling fines passing through the center of the mill or the suction pipe.

3. An improvement according to claim 1, in which said rock lifter bars are fixed at an angle of inclination of 10° to 45° as determined by optimum conditions, the mill operating at a speed of 60% to 85% of its critical speed.

4. An improvement according to claim 3, in which the optimum condition is the eve wear pattern of the rock lifter bars.

5. An improvement according to claim 3, in which the optimum condition is the highest productivity of the mill.

6. An improvement according to claim 3, in which the optimum condition is the lowest kilowatt hours used per ton of the material.

7. An improvement according to claim 3, in which the optimum condition is the best quality of the final product.

8. An improvement according to claim 3, in which said angle of inclination of the rock lifter bars and said operating speed are determined by the optimum working conditions.

9. An improvement according to claim 3 wherein the carriers for the crashed fines have an angle of inclination 25° to 50° smaller than that of said rock lifter bars.

* * * * *